United States Patent [19]

Bodine

[11] 4,026,481

[45] May 31, 1977

[54] SONIC COMPRESSING DEVICE UTILIZING MULTIPLE GYRATORILY VIBRATED DRIVE BARS

[76] Inventor: Albert G. Bodine, 7877 Woodley Ave., Van Nuys, Calif. 91406

[22] Filed: Apr. 19, 1976

[21] Appl. No.: 678,415

[52] U.S. Cl. ..... 241/266

[51] Int. Cl.[2] ..... B02C 1/06

[58] Field of Search ..... 241/264, 266, 267; 100/41, 233, 236

[56] References Cited

UNITED STATES PATENTS

| | | | |
|---|---|---|---|
| 3,075,711 | 1/1963 | Kautz | 241/266 |
| 3,414,203 | 12/1968 | Bodine | 241/266 |
| 3,536,001 | 10/1970 | Bodine | 100/41 |

*Primary Examiner*—Granville Y. Custer, Jr.

*Attorney, Agent, or Firm*—Edward A. Sokolski

[57] ABSTRACT

A compressing device which may be utilized for such purposes as crushing rock or compacting material, has a pair of oppositely positioned jaws. Each jaw has a plurality of longitudinal bars attached thereto, which bars are resonant in a gyratory lateral mode, these bars being spaced from each other along the material flow path extent of their associated jaws. Means are provided to resonantly vibrate each of the jaws in a gyratory vibration mode with the bars for each jaw vibrating in a manner such as to cause a unified jaw vibration. In the preferred embodiment, the resonant bars are hollow with the oscillator means for each bar comprising a plurality of eccentric weights attached to the ends of the bars and mounted for rotation on an axis parallel to the axis of the bar.

6 Claims, 6 Drawing Figures

SONIC COMPRESSING DEVICE UTILIZING MULTIPLE GYRATORILY VIBRATED DRIVE BARS

This invention relates to a device for compressing or crushing material, and more particularly to such a device utilizing gyratory sonic vibration in achieving this end result.

In my U.S. Pat. No. 3,536,001, in connection with FIG. 7 thereof, a technique for compacting material between a pair of jaws which are driven by associated pairs of gyratory resonantly vibrated bar members is described. The bar members in this patent are excited in a gyratory mode of vibration which functions to compact and drive the material between the tapered jaw members, thereby achieving the desired compaction thereof.

The device of the present invention is an improvement over that of my aforementioned patent, and is particularly useful in situations where jaws having a fairly large longitudinal or material treatment extent are needed, in which situation a plurality of spaced bars for each jaw provide a distinct advantage. It is to be noted along these lines that with jaws having a fairly large longitudinal extent, the use of only a single bar for each jaw sometimes results in an undesirable torque or tipping of the jaws when the load is off center. This problem is fully eliminated in the present invention. Further, in using a plurality of bar members for each jaw, the present invention is able to maintain high Q resonant operation at all times, even when the load is exactly opposite only a pair of the bars, in view of the fact that there are always some of the bars which are not so heavily loaded. It is also to be noted that the avoidance of tipping action of the jaws eliminates its resultant wasteful parasitic torsional vibration, thereby contributing to better efficiency of the system. The avoidance of this tipping action also avoids the resultant sudden opening of the output region of the jaws which may spill the load through before it has been properly compressed or crushed.

The present invention has a particular advantage for use in large machines where the use of a plurality of smaller bars rather than a single pair of very large bars simplifies and economizes manufacture. This same advantage accrues by virtue of the use of a separate oscillator for each bar in the present invention, enabling the use of smaller oscillator components as compared with devices of the prior art which utilize a single oscillator for the entire system. This end result is achieved in one form of the present invention by a unique oscillator design wherein all of the oscillators may be driven by a single drive motor.

Referring now to the drawings.

Figure 1:
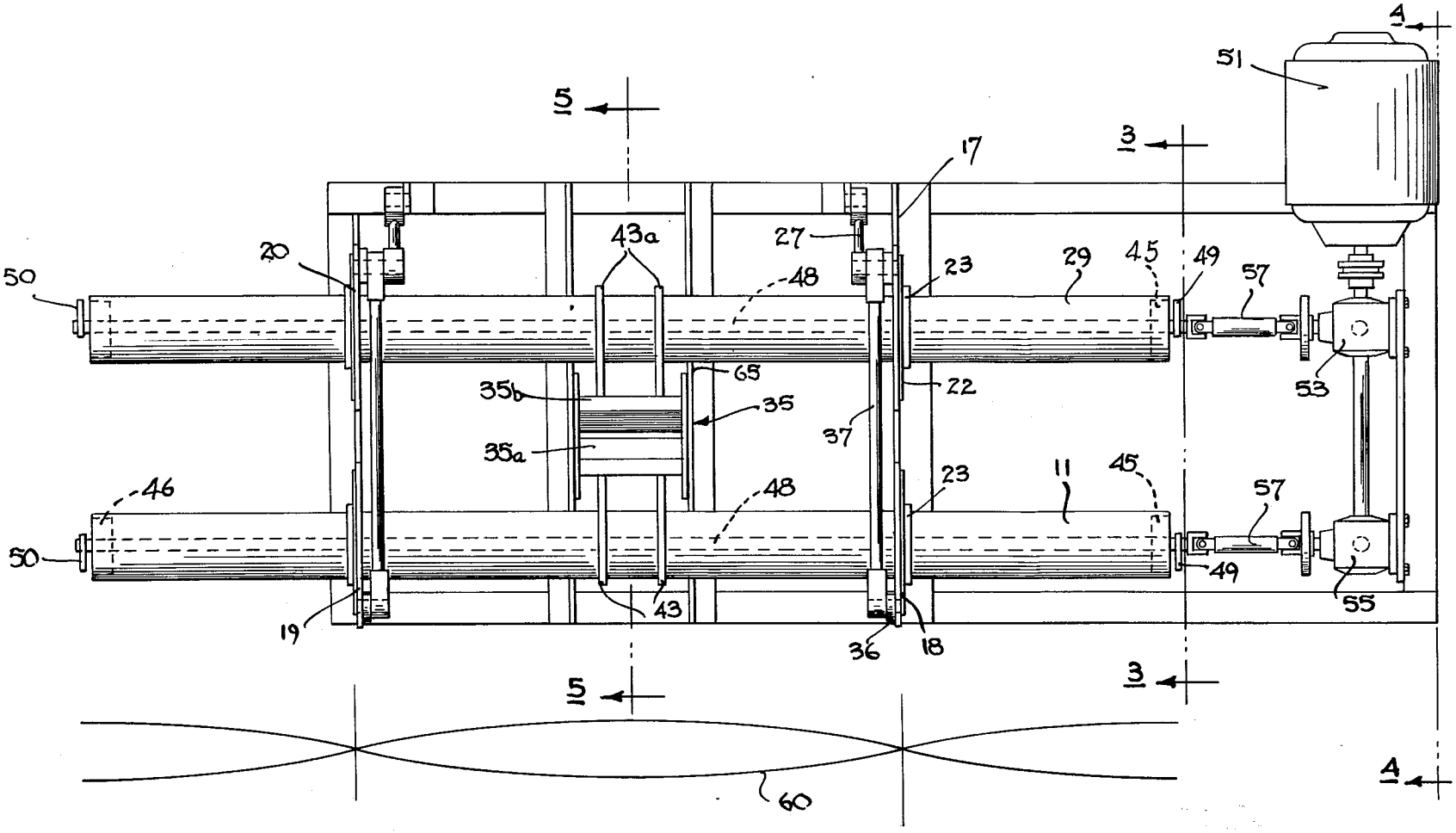
FIG. 1 is a top plan view of one embodiment of the invention.
Figure 2:
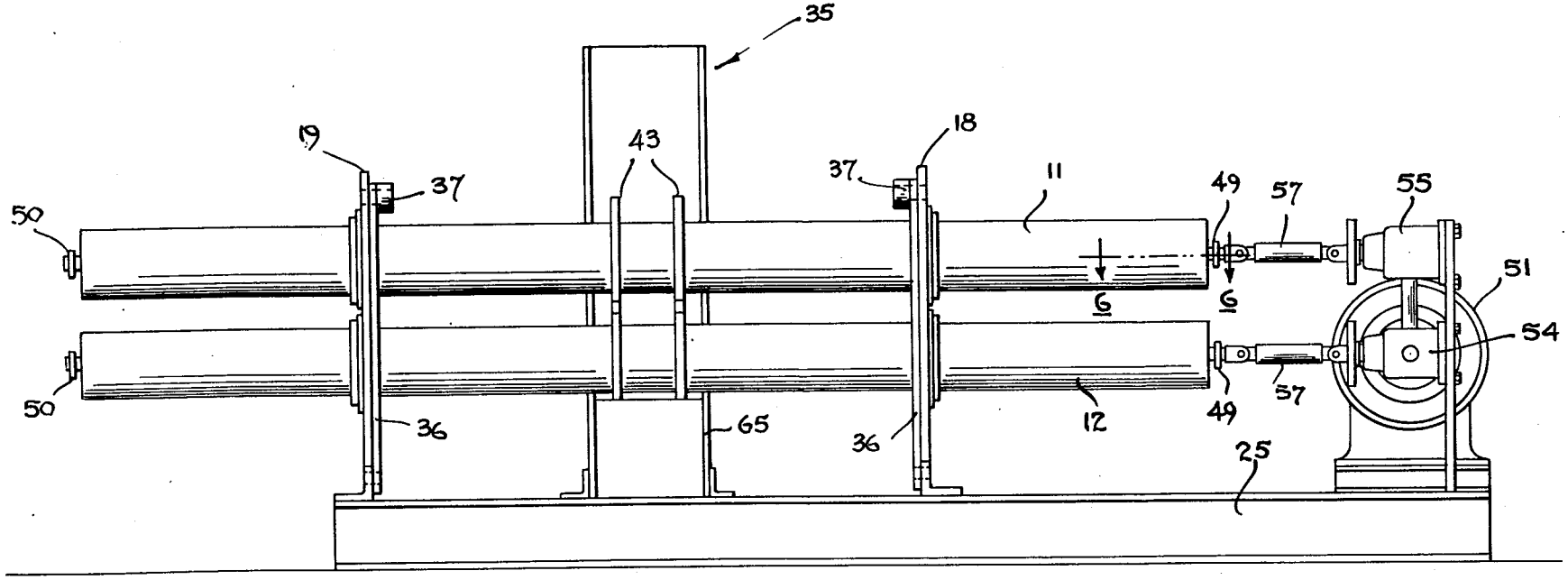
FIG. 2 is a side elevational view of the embodiment of FIG. 1.
Figure 6:
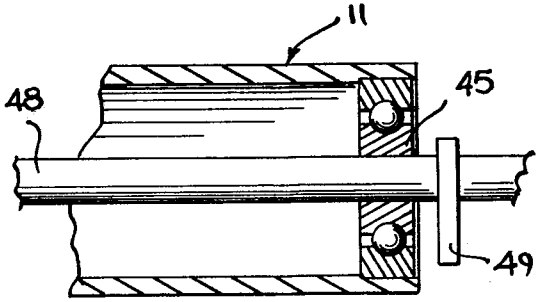
FIG. 6 is a cross-sectional view taken along the plane indicated by 6—6 in FIG. 2.
Figure 3:
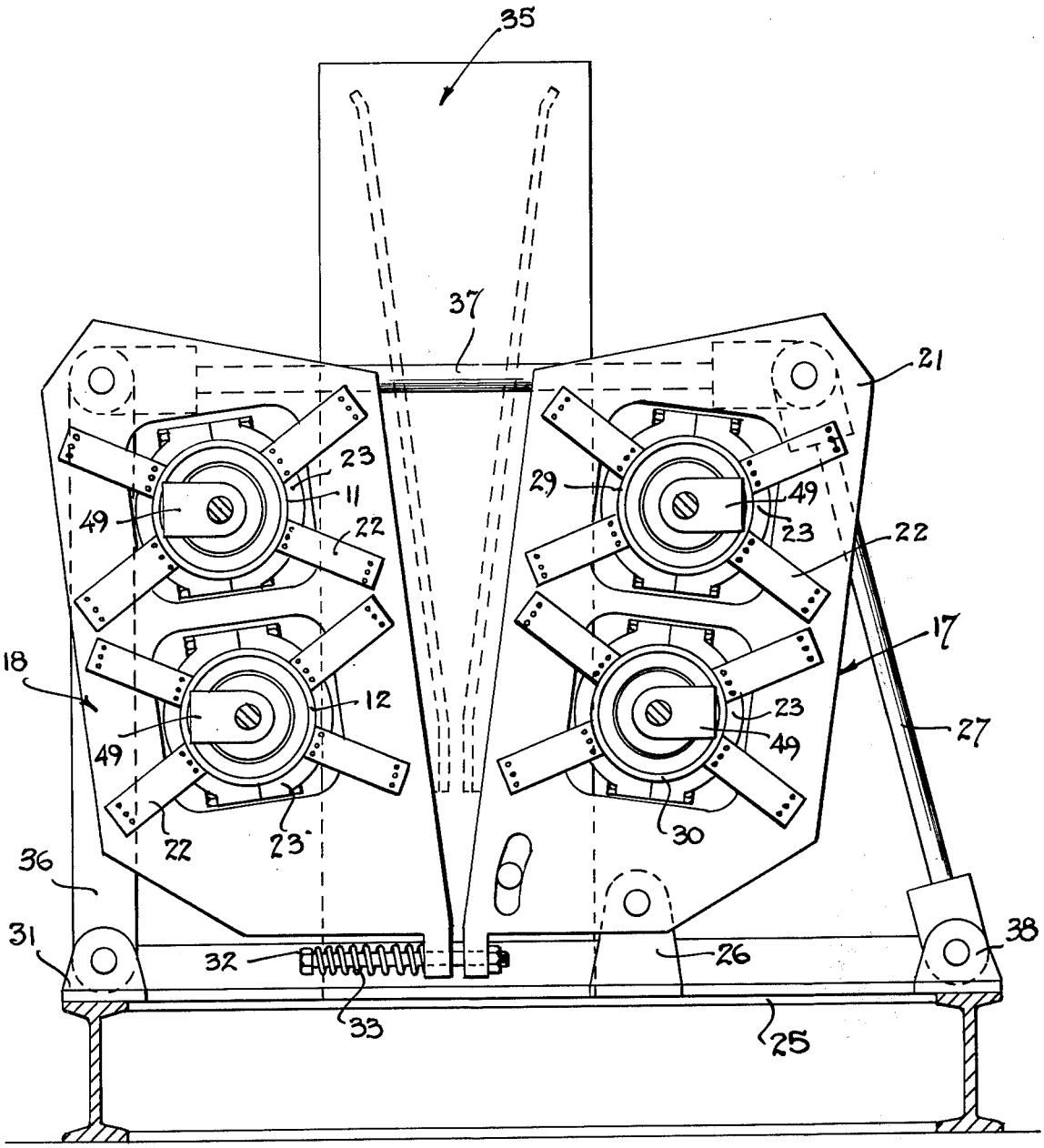
FIG. 3 is a cross-sectional view of the embodiment of FIG. 1 taken along the plane indicated by 3—3 in FIG. 1.
Figure 4:
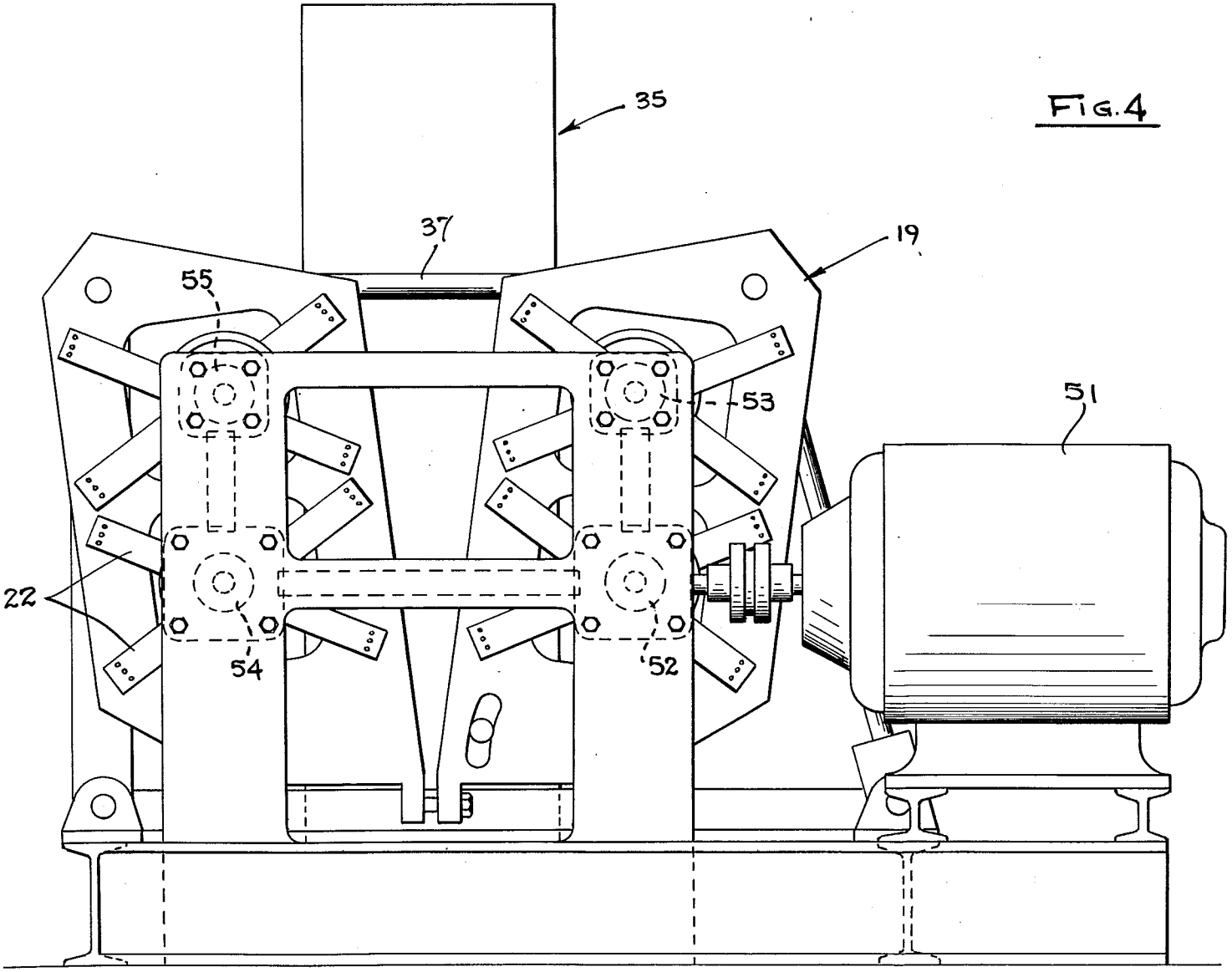
FIG. 4 is an end elevational view of the embodiment of FIG. 1 taken along the plane indicated by 4—4 in FIG. 1.
Figure 5:
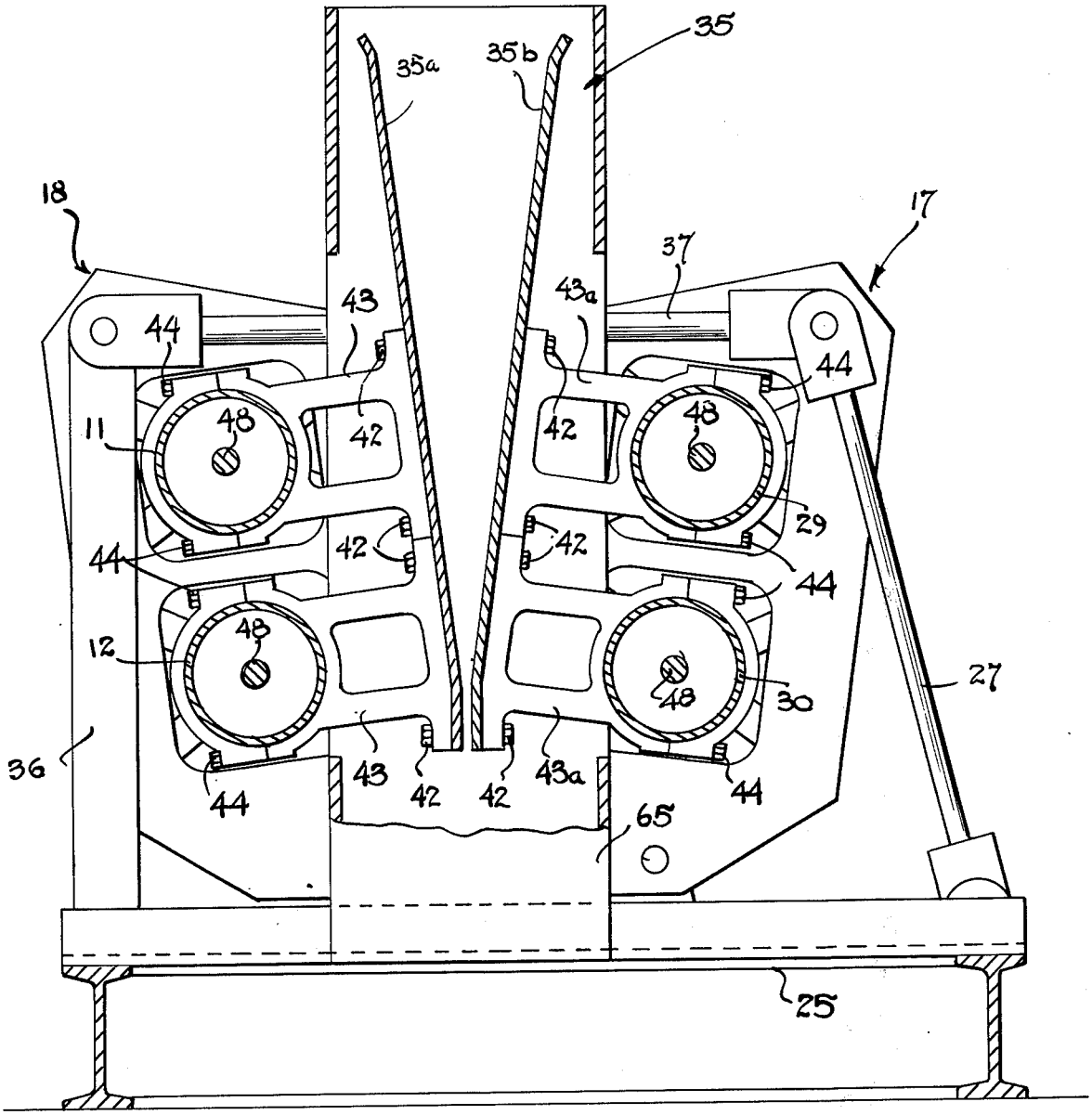
FIG. 5 is a cross-sectional view taken along the plane indicated by 5—5 in FIG. 1.

Briefly described, my invention is as follows: A pair of jaws for use in compressing or crushing material are each separately attached to a plurality of parallel longitudinal bar members, the typically horizontal bar members being spaced vertically from each other along the typically vertical longitudinal treatment extent of their associated jaws. Means are provided for supporting the bar members at their resonant nodal points. Each bar member is resonantly driven in a gyratory mode of vibration by means of a separate orbiting mass oscillator. In the disclosed embodiment, the resonant bar members are hollow, all of the oscillators being driven by a common motor and formed by eccentric weights which are fixedly attached to a shaft which is rotatably mounted along and within an associated one of the hollow bar members. The eccentric weights are rotatably driven at an appropriate speed such as to cause gyratory lateral elastic resonant vibration of their associated bar members. The bar members attached to each jaw have their oscillators phased with respect to each other so that the vibratory energy fed to each jaw from all of the bar members associated therewith is additive. Further, the phasing of the energy supplied to one jaw is in opposition to that supplied to the other such as to effect periodic compression and propelling action on the load.

It has been found most helpful in analyzing this invention to analogize the acoustically vibrating circuit utilized to an equivalent electrical circuit. This sort of approach to analysis is well known to those skilled in the art and is described, for example, in Chapter 2 of *Sonics* by Hueter and Bolt, published in 1955 by John Wiley and Sons. In making such an analogy, force F is equated with electrical voltage E, velocity of vibration $u$ is equated with electrical current $i$, mechanical compliance $C_m$ is equated with electrical capacitance $C_e$, mass M is equated with electrical inductance L, mechanical resistance (friction) $R_m$ is equated with electrical resistance R and mechanical impedance $Z_m$ is equated with electrical impedance $Z_e$.

Thus, it can be shown that if a member is elastically vibrated by means of an acoustical sinusoidal force $F_o \sin\omega t$ ($\omega$ being equal to $2\pi$times the frequency of vibration), that $$Z_m = R_m + j\left(\omega M - \frac{1}{\omega C_m}\right) = \frac{F_o \sin\omega t}{u} \qquad (1)$$

Where $\omega M$ is equal to $$\frac{1}{\omega C_m}$$

a resonant condition exists, and the effective mechanical impedance $Z_m$ is equal to the mechanical resistance $R_m$, the reactive impedance components $\omega M$ and $$\frac{1}{\omega C_m}$$

cancelling each other out. Under such a resonant condition, velocity of vibration $u$ is at a maximum, power factor is unity, and energy is more efficiently delivered to a load to which the resonant system may be coupled.

It is important to note the significance of the attainment of high acoustical "Q" in the resonant system being driven, to increase the efficiency of the vibration thereof and to provide a maximum amount of power. As for an equivalent electrical circuit, the Q of an acoustically vibrating circuit is defined as the sharpness of resonance thereof and is indicative of the ratio of the energy stored in each vibration cycle to the energy used in each such cycle. Q is mathematically equated to the ratio between $\omega M$ and $R_m$. Thus, the effective Q of the vibrating circuit can be maximized to make for highly efficient high-amplitude vibration by minimizing the effect of friction in the circuit and/or maximizing the effect of mass in such circuit. The use of multiple bar members in the present invention significantly improves the Q of the resonant system.

In considering the significance of the parameters described in connection with equation (1), it should be kept in mind that the total effective resistance, mass, and compliance in the acoustically vibrating circuit are represented in the equation and that these parameters may be distributed throughout the system rather than being lumped in any one component or portion thereof.

It is also to be noted that orbiting-mass oscillators are utilized in the implementation of the invention that automatically adjust their output frequency and phase to maintain resonance with changes in the characteristics of the load. Thus, in the face of changes in the effective mass and compliance presented by the load with changes in the conditions of the work material as it is sonically excited, the system automatically is maintained in optimum resonant operation by virtue of the "lock-in" characteristic of applicant's unique orbiting-mass oscillators. Furthermore, in this connection the orbiting-mass oscillator automatically changes not only its frequency but its phase angle and therefore its power factor with changes in the resistive impedance load, to assure optimum efficiency of operation at all times. The vibrational output from such orbiting-mass oscillators also tends to be constrained by the resonator to be generated along a controlled predetermined coherent path to provide maximum output along a desired axis.

Referring now to the Figures, one embodiment of the invention is illustrated. This particular embodiment is suitable for use as a rock crusher. A first pair of hollow bars 11 and 12 which are fabricated of an elastic material such as steel, are supported by means of support plates 18 and 19 at positions therealong where nodes are formed in the standing wave vibration pattern set up in these bars (as later to be described). At the support locations, each of the bars has a ring 23 force fitted thereon, rings 23 and their attached bars being resiliently supported on plates 18 and 19 and vibrationally insulated therefrom by means of elastic straps or spacers 22, which may be of rubber and are bolted to the rings and the plates. Plates 18 and 19 are supported on base 25 by means of brackets 31 (attached to the base) and support arms 36 which are attached at one end to their associated brackets 31 and at the other end to the associated support plate. Bars 29 and 30 are similar to bars 11 and 12 and are similarly supported on plates 17 and 20, these last mentioned plates being supported on base 25 by means of brackets 26 and support arms 27 which are connected to brackets 38. The top portions of plates 17 and 18 and 19 and 20 are joined together in each instance by an arm 37. The bottom of plate 17 is joined to the bottom of plate 18, and the bottom of plate 19 to the bottom of plate 20 by means of bolts 32 which have springs 33 mounted thereon, the bolts fitting loosely through the plates against which the springs abut, so that in the event a piece of tramp iron becomes jammed in the device, the plates, bars (and jaws) will be able to move apart so as to avoid damage to the equipment.

Jaw assembly 35 includes a pair of oppositely positioned jaws **35*a* and 35*b*. Connected to bars 11 and 12 at a position therealong where the antinode in the vibration pattern appears is jaw 35*a*. Jaw 35*a* is in the form of a flat broad plate. Secured to jaw 35*a* by means of bolts 42 are a pair of brackets 43. Brackets 43 are respectively clamped to bars 11 and 12 by means of bolts 44. Jaw 35*b* is similarly connected to and supported on bars 29 and 30 by means of brackets 43*a*, which in turn are clamped to bars 29 and 30**. It is again to be noted that the jaws are connected to the bars at points therealong which are in the vicinity of the locations of the antinodes in the resonant standing wave vibration set up in the bars.

Bars 11, 12, 29 and 30 are hollow and are fabricated of an elastic material such as steel. Mounted within each bar on ballbearing mounts 45 and 46 attached to the interior of the bars at the opposite ends thereof is a longitudinal shaft 48. Shafts 48 protrude out from opposite ends of their associated bars. Fixedly attached to each shaft 48 near the opposite ends thereof are paired eccentric weights 49 and 50. The shaft 48 for each of the bars is rotatably driven by means of motor 51, the output shaft of which is coupled to the shafts 48 through gear boxes 52–55 and coupling shafts 57. The eccentric weights 49 and 50 of bars 11 and 12 are all positioned in the same angular location on their associated shafts so that when the shafts are rotatably driven, the gyratory vibrational energy generated in bars 11 and 12 will be transferred to jaw **35*a* in additive relationship. Similarly, additive vibrational energy is transferred to jaw 35*b* from bars 29 and 30. The energy supplied to jaw 35*a* is in vibratory opposition to that transferred to jaw 35*b* to provide a vibrational compaction and propelling force to material placed between the jaws. This end result may be achieved by positioning the eccentric weights 49 and 50 of bars 11 and 12 in 180° phase relationship to those of bars 29 and 30, and by rotating the shafts of bars 11 and 12 in opposite direction to the shafts of bars 29 and 30**.

In operation, the shafts 48 are rotatably driven by motor 51 at a speed such as to set up resonant gyratory vibration in each of bars 11, 12, 29 and 30, with a standing wave pattern being formed in each of the bars as indicated by graph lines 60. As can be seen, the nodal points of the standing wave patterns appear along the bars where the bars are supported on base 25, thus minimizing the dissipation of energy in the base. On the other hand, the anti-nodal points of maximum vibration occur in the region where the bars are clamped to the jaws. In view of the phasing of the eccentric weights and the synchronous driving of the shafts from the same power source, the bars coupled to each jaw are vibrationally excited in unison such as to provide an additive unitary vibrational drive force to the associated jaw. Further, as already noted, the vibrational energy transferred to one jaw is opposed to that transferred to the other to provide the desired compression and propelling action on the material placed in the jaws. The crushed or compressed material is received in hopper 65 mounted on base 25 beneath the jaws.

While the invention has been described and illustrated in detail, it is to be clearly understood that this is by way of illustration and example only and is not to be taken by way of limitation, the spirit and scope of the invention being limited only by the terms of the following claims.

I claim:

1. A device for compressing material comprising:

a pair of oppositely positioned jaws having a substantial longitudinal extent along which the treated material progresses, a first set of longitudinal bar members adapted for resonance in a lateral mode of vibration, one of said jaws being attached to said first set of bar members with said bar members being spaced from each other along the longitudinal extent of said first jaw, a second set of resonant bar members, the other of said jaws being attached to said second set of bar members with said second set of bar members being spaced from each other along the longitudinal extent of said other of said jaws, and means for providing vibrational energy to said bar members to cause said bar members to resonantly vibrate in a gyratory bending mode with the vibration of the bars of each set being in unison and the vibration of the first set of bars being in opposition to the vibration of said second set of bars, whereby the jaws are vibrationally driven in opposing relationship to compress the material therebetween.

2. The device of claim 1 wherein the jaws are supported on their associated bars in a region where the anti-node of the resonant vibration pattern set up in the bars appears.

3. The device of claim 1 wherein said bars are hollow and said means for generating vibrational energy in said bars comprises a shaft rotatably mounted within each of said bars, eccentric weight means mounted on each of said shafts, and motor means for rotatably driving said shafts.

4. The device of claim 3 wherein said eccentric weight means comprises a pair of eccentric weights, said weights being mounted near the opposite ends of said shaft.

5. The device of claim 1 wherein each set of bars comprises a pair of bars and means for supporting each of said pairs of bars at a position therealong corresponding to the nodal points of the resonant vibration established therein.

6. The device of claim 5 wherein said means for supporting said bars comprises a support plate, a base on which said support plate is mounted, a clamp fitted onto each of said bars and resilient strap means for supporting said clamp on said plate in vibrationally insulated relationship.

* * * * *